US006601350B1

(12) United States Patent
Isoda

(10) Patent No.: US 6,601,350 B1
(45) Date of Patent: Aug. 5, 2003

(54) STRUCTURE FOR INSTALLING A VISCOUS VIBRATION-DAMPING WALL AND METHOD OF INSTALLING THE SAME

(75) Inventor: Kazuhiko Isoda, Tokyo (JP)

(73) Assignee: Shimizu Corporation, Tokyo (JP)

( * ) Notice: Subject to any disclaimer, the term of this patent is extended or adjusted under 35 U.S.C. 154(b) by 0 days.

(21) Appl. No.: 09/763,230

(22) PCT Filed: Sep. 1, 1999

(86) PCT No.: PCT/JP99/04738

§ 371 (c)(1),
(2), (4) Date: Feb. 20, 2001

(87) PCT Pub. No.: WO00/12843

PCT Pub. Date: Mar. 9, 2000

(30) Foreign Application Priority Data

Sep. 1, 1998 (JP) ..... 10-247367

(51) Int. Cl.[7] ..... E04H 9/02
(52) U.S. Cl. ..... 52/167.1; 52/167.2
(58) Field of Search ..... 52/167.1, 167.2

(56) References Cited

U.S. PATENT DOCUMENTS 5,349,794 A * 9/1994 Taga ..... 52/167.1
6,037,403 A * 3/2000 Katase et al. ..... 252/572

FOREIGN PATENT DOCUMENTS

| | | | | |
|---|---|---|---|---|
| DE | 003305128 a1 | * | 8/1984 | ..... E04B/1/58 |
| EP | 1 111 163 | * | 9/1998 | ..... E04H/9/02 |
| EP | 1 126 101 A1 | * | 8/2001 | ..... E04H/9/02 |
| JP | 59-52069 | | 3/1984 | |
| JP | 405086744 A | * | 4/1993 | ..... E04H/9/02 |
| JP | 406017557 a | * | 1/1994 | ..... E04H/9/02 |
| JP | 406066044 a | * | 3/1994 | ..... E04H/9/02 |
| JP | 8-338153 | | 12/1996 | |
| JP | 9-310531 | | 12/1997 | |
| JP | 10-46865 | | 2/1998 | |
| JP | 10199357 | * | 7/1998 | ..... E04H/9/02 |
| JP | 10199905 | * | 7/1998 | ..... E04H/9/02 |
| JP | 10-220063 | | 8/1998 | |
| JP | 200073612 A | * | 9/1998 | ..... E04H/9/02 |
| JP | 200165193 A | * | 8/1999 | ..... E04H/9/02 |
| JP | 2000041199 | * | 2/2000 | ..... E04H/9/02 |
| JP | 200221369a | * | 7/2000 | ..... E04H/9/02 |
| JP | 2000220318 A | * | 8/2000 | ..... E04H/9/02 |
| JP | 2001123698 A | * | 5/2001 | ..... E04H/9/02 |

* cited by examiner

*Primary Examiner*—Carl D. Friedman
*Assistant Examiner*—Kevin McDermott
(74) *Attorney, Agent, or Firm*—Nixon & Vanderhye

(57) ABSTRACT

In a structure for installing a viscous vibration-damping wall, high-strength bolt hole portions are provided for connecting a lower-floor girder and a base plate forming part of the wall. Gusset plates are disposed on both sides of the group of the high-strength bolt hole portions. A pair of flange plates are respectively provided with a pair of gusset plates. High-strength bolt hole portions and a pair of gusset plates for connection to opposing gusset plates are embedded in a flange of the lower-floor girder, to connect the viscous vibration-damping wall and the lower-floor girder. The viscous vibration-damping wall is connected to an upper-floor girder by directly connecting a gusset plate fixed to the upper-floor girder and an intermediate plate of the viscous vibration-damping wall.

12 Claims, 13 Drawing Sheets

STRUCTURE FOR INSTALLING A VISCOUS VIBRATION-DAMPING WALL AND METHOD OF INSTALLING THE SAME

This application is the U.S. national phase of international application No. PCT/JP99/04738, filed Sep. 1, 1999, which designated the U.S.

TECHNICAL FIELD

The present invention relates to a structure for installing a viscous vibration-damping wall and a method of installing the same, and more particularly to a structure for installing a viscous vibration-damping wall whose connecting structure is simple and which, while possessing a sufficient withstanding force, can be manufactured at low cost by making improvements on the structure for installing the viscous vibration-damping wall on a main frame structure, as well as a method of installing the same.

BACKGROUND ART

Measures for enhancing the damping performance of structures have been adopted since ancient times to enhance the safety of earthquake resistance of building structures and improve the dwelling ability of structures against the wind and other dynamic external forces. As specific solutions therefor, viscous vibration-damping walls have been put to practical use, and the number of the viscous vibration-damping walls actually adopted has been on an increasing trend in recent years.

The viscous vibration-damping wall is constructed such that an upper-end open housing, which is formed by a pair of steel-made side plates mounted on a base plate and a pair of flange plates disposed on both sides of the pair of side plates, is integrated with a lower-floor girder, an intermediate plate integrated with an upper-floor girder is inserted in it, and a viscous material or a viscoelastic material is placed in the gap therebetween with a predetermined thickness.

To build the vibration-damping wall, connection to a main frame structure is required, but under the present circumstances connection metal plates from the main frame structure for connection to the viscous vibration-damping wall include a large number rib plates and make the joints complex, constituting a factor for higher cost.

Referring to FIG. 13, a description will be given of the connection between a conventional viscous vibration-damping wall and the main frame structure. A base plate 52 of a housing 51 making up a vibration-damping wall 50 is bolted to a flange surface of a rising metal plate 54 disposed on a lower-floor girder 53, while an intermediate plate 55 of the vibration-damping wall has a top plate 56 welded to its tip portion and is bolted to a flange surface of a mounting plate 58 disposed on an upper-floor girder 57.

In this state, when the vibration-damping wall 50 bears a horizontal force due to an external force, bending moment due to the borne shearing force occurs in the top plate 56 and the base plate 52 at the upper and lower ends.

The stress applied to the joints acts as the horizontal shearing force with respect to the bolts at the plane of connection, and at the same time a vertical axial force which is distributed widely at the edge portions of the vibration-damping wall 50 occurs in the bolts at the plane of connection due to the bending moment. As a result, large bending stresses occur in the top plate 56 and the base plate 52 having bolt hole portions arranged horizontally, so that it is necessary to adopt countermeasures for the respective plates.

Consequently, as shown in the drawing, a multiplicity of vertical rib plates 59 and 60 are fixed to the base plate 52 and the top plate 56 as well as the rising metal plate 54 and the mounting plate 58 corresponding thereto, and large-scale reinforcement is provided particularly at the edge portions of the vibration-damping wall. This results in an enormously large increase in cost, and constitutes a hindrance to the connection to a member perpendicular to a girder, and to through holes of sleeves of the facility.

Since the damping performance which can be added to a structure is proportional to the quantity of vibration-damping walls that are installed, it is desirable to adopt a large number of vibration-damping walls. However, since the cost required in the installation is also proportional to the quantity used, it is an important problem to reduce the cost of the building construction of the vibration-damping walls and to prevent adverse effects from being exerted on other execution of works.

To overcome this problem, as shown in FIG. 14, a method of building construction has been proposed in which all the upper and lower flange portions are removed. (Refer to JP-A-10-46865).

In this proposal, as shown in the drawing, a bolting steel plate 72 is provided which has the same thickness as an inner wall steel plate 71 of a vibration-damping wall 70 to be fixed to the underside of an upper-floor girder or a reinforced portion thereof, and the inner wall steel plate 71 of the vibration-damping wall is disposed immediately therebelow. A pair of bolting reinforcing plates 73 are disposed on both sides of the inner wall steel plate 71, and the three steel plates are tightened by high-strength bolts 74 so as to be integrated.

In addition, on a lower floor side, a bolting lower steel plate 76 is welded in advance to lower sides of a pair of outer wall steel plates 75 of the vibration-damping wall, and a steel plate 77 of the same thickness as the bolting lower steel plate 76 is provided on a lower-floor girder, and is integrated therewith in the same way as the upper side.

An assertion is made that it is possible to substantially reduce the cost required for the overall building construction of the vibration-damping wall, since the mechanism for transmitting the stress can be rationalized and the fabrication of the vibration-damping wall itself and the fixing portions can be both simplified by virtue of the construction in which flanged connection in each of the upper and lower portions is eliminated, as described above.

However, with the vibration-damping wall according to this proposal, the vibration-damping wall itself is specially provided with the bolting lower steel plate, the inner wall steel plate is provided with an upper reinforced portion, and the friction-type high-strength bolted connection for jointing adopts a structure in which a multiplicity of bolts are arranged on end portion sides of the vibration-damping wall. Such a construction is a natural consequence of the fact that the bolting lower steel plate and the inner wall steel plate need to simultaneously withstand both the shearing force and the tensile force with respect to the bending moment occurring in the vibration-damping wall. A substantial thickness must be inevitably secured for the bolting lower steel plate, so that the cost of the vibration-damping wall itself is not much different from other conventional vibration-damping walls.

In addition, concerning the handling of the vibration-damping wall, since the structure adopted is such that the vibration-damping wall cannot be self-supported, special attention is required for safety and workability under the circumstances of transportation, storage, and on-site setting.

The present invention provides a structure for installing a viscous vibration-damping wall which is simple while possessing a sufficient withstanding force, and which can be manufactured at low cost by making improvements on the structure for connection at the time of installing the viscous vibration-damping wall on a main frame structure, as well as a method of installing the same.

DISCLOSURE OF INVENTION

The structure for installing a viscous vibration-damping wall in accordance with a first aspect of the present invention is a structure for installing a viscous vibration-damping wall in which a housing with its upper end open is formed by uprightly setting a pair of steel-made side plates on a base plate and by disposing a pair of flange plates on both sides of the pair of side plates, an intermediate plate is inserted in the housing, and a viscous material or a viscoelastic material is placed in its gap portion, characterized in that the base plate of the viscous vibration-damping wall in its central portion is provided with high-strength bolt hole portions for connection to a flange of a lower-floor girder, and has on both sides of a group of the high-strength bolt hole portions a pair of gusset plates suspended in the same direction as that of the intermediate plate from the base plate down to a position at a short distance therefrom, that the pair of flange plates respectively have a pair of gusset plates suspended therefrom orthogonally with respect to the intermediate plate down to the position at the short distance from the base plate, that the flange of the lower-floor girder is provided with high-strength bolt hole portions opposing the high-strength bolt hole portions of the central portion of the base plate, that gusset plates opposing the gusset plates suspended from the base plate and gusset plates opposing the gusset plates suspended from the flange plate are embedded in the lower-floor girder on both sides of the high-strength bolt hole portions of the flange of the lower-floor girder, that the viscous vibration-damping wall is connected to the lower-floor girder by appropriately connecting opposing ones of the high-strength bolt hole portions and opposing ones of the gusset plates, and that the viscous vibration-damping wall is connected to an upper-floor girder by directly connecting the intermediate plate and a gusset plate fixed to a flange of the upper-floor girder.

The structure for installing a viscous vibration-damping wall in accordance with second, third, and fourth aspects of the present invention is characterized in that, in the first aspect, the base plate of the viscous vibration-damping wall has in its central portion a joining member, and the joining member is provided with high-strength bolt hole portions, that the joining member and the pair of gusset plates suspended from the base plate are formed integrally, and that base plate portions on both sides of the central portion which are respectively provided with the pair of gusset plates suspended therefrom are raised toward the upper-floor girder relative to the central portion provided with the high-strength bolt hole portions, so as to be respectively provided with steps.

The structure for installing a viscous vibration-damping wall in accordance with a fifth aspect of the present invention is characterized in that, in each of the above-described aspects, the connection of the gusset plates is effected only between each of the gusset plates suspended from the base plate and each of the gusset plates embedded in the lower-floor girder and opposed to the gusset plates, thereby making it possible to provide adjustment in correspondence with the relative magnitude of the vertical stress.

The structure for installing a viscous vibration-damping wall in accordance with a sixth aspect of the present invention is characterized in that, in each of the above-described aspects, a rising metal plate is installed on the flange of the lower-floor girder, and is provided with high-strength bolt hole portions, with the result that it is possible to prevent the base material from being damaged by the provision of bolt holes in the flange of the upper-floor girder which is part of the main frame structure.

The structure for installing a viscous vibration-damping wall in accordance with seventh to 10th aspects of the present invention is characterized in that, in each of the above-described aspects, the connection between the respective gusset plates is effected by one-plane friction-type high-strength bolted connection or two-plane friction-type high-strength bolted connection using a pair of splicing plates.

The structure for installing a viscous vibration-damping wall in accordance with 11th, 12th, and 13th aspects of the present invention is characterized in that the direct connection between the intermediate plate and the gusset plate suspended from the upper-floor girder is effected by one-plane friction-type high-strength bolted connection or two-plane friction-type high-strength bolted connection using a pair of splicing plates, and that each of the splicing plates is divided into a central portion and a pair of side portions.

By virtue of the structure for installing a viscous vibration-damping wall in accordance with the present invention, the top plate, the brackets, and the reinforcing rib plates at various portions which have been used in the conventional building construction of the vibration-damping wall are made unnecessary, and the reduction of the thickness of the base plate and the number of bolts is attained. Further, since the vibration-damping wall is self-supported and stabilized, the safety of construction work and workability are improved.

The method of installing a viscous vibration-damping wall in accordance with the first aspect of the present invention is characterized by comprising the steps of: fixing the lower-floor girder to a pair of pillars disposed on both sides thereof, the lower-floor girder being constructed such that the flange is provided with the high-strength bolt hole portions for connection to the base plate, and the pair of gusset plates opposing the pair of gusset plates suspended from the base plate on both sides of the group of the high-strength bolt hole portions as well as the pair of gusset plates opposing the pair of gusset plates respectively suspended from the pair of flange plates are embedded in the lower-floor girder; setting at a predetermined position the upper-floor girder with which the viscous vibration-damping wall is integrated by connecting the intermediate plate of the viscous vibration-damping wall to the gusset plate disposed on a bracket and by connecting the housing to the upper-floor girder by means of a pair of temporary suspending pieces; appropriately connecting opposing ones of the high-strength bolt hole portions and opposing ones of the gusset plates of the viscous vibration-damping wall and the lower-floor girder; and removing the temporary suspending pieces. Therefore, handling can be made simple, shear deformation of the viscous material can be prevented, and the movability of the vibration-damping wall can be prevented.

The structure for installing a viscous vibration-damping wall in accordance with the first aspect of the present invention is basically a structure for installing a viscous vibration-damping wall in which a housing with its upper end open is formed by uprightly setting a pair of steel-made side plates on a base plate and by disposing a pair of flange plates on both sides of the pair of side plates, an intermediate plate is inserted in the housing, and a viscous material or a viscoelastic material is placed in its gap portion, characterized in that the base plate of the viscous vibration-damping wall in its central portion is provided with high-strength bolt hole portions for connection to a flange of a lower-floor girder, and has on both sides of a group of the high-strength bolt hole portions a pair of gusset plates suspended in the same direction as that of the intermediate plate from the base plate down to a position at a short distance therefrom, that the pair of flange plates respectively have a pair of gusset plates suspended therefrom orthogonally with respect to the intermediate plate down to the position at the short distance from the base plate, that the flange of the lower-floor girder is provided with high-strength bolt hole portions opposing the high-strength bolt hole portions of the central portion of the base plate, that gusset plates opposing the gusset plates suspended from the base plate and gusset plates opposing the gusset plates suspended from the flange plate are embedded in the lower-floor girder on both sides of the high-strength bolt hole portions of the flange of the lower-floor girder, that the viscous vibration-damping wall is connected to the lower-floor girder by appropriately connecting opposing ones of the high-strength bolt hole portions and opposing ones of the gusset plates, and that the viscous vibration-damping wall is connected to an upper-floor girder by directly connecting the intermediate plate and a gusset plate fixed to a flange of the upper-floor girder. Therefore, advantages are offered in that the top plate, the brackets, and the reinforcing rib plates at various portions which have been used in the conventional building construction of the vibration-damping wall are made unnecessary, a simple and rational structure can be formed, and the reduction of the thickness of the base plate and the number of bolts is attained, thereby making it possible to reduce the cost. Further, since the viscous vibration-damping walls can be manufactured without substantially changing a line for manufacturing the viscous vibration-damping walls, and the vibration-damping wall can be self-supported, an advantage can be demonstrated in that the safety of construction work and workability can be improved in all aspects including the manufacture, transportation, temporary storage, and installation.

In addition, since the structure for installing a viscous vibration-damping wall in accordance with the following aspects of the present invention is so arranged that the above-described operational advantages can be attained more actively and efficiently, an advantage is offered in that the intended object can be attained sufficiently.

In addition, the method of installing a viscous vibration-damping wall in accordance with the first aspect of the present invention is characterized by comprising the steps of: fixing the lower-floor girder to a pair of pillars disposed on both sides thereof, the lower-floor girder being constructed such that the flange is provided with the high-strength bolt hole portions for connection to the base plate, and the pair of gusset plates opposing the pair of gusset plates suspended from the base plate on both sides of the group of the high-strength bolt hole portions as well as the pair of gusset plates opposing the pair of gusset plates respectively suspended from the pair of flange plates are embedded in the lower-floor girder; setting at a predetermined position the upper-floor girder with which the viscous vibration-damping wall is integrated by connecting the intermediate plate of the viscous vibration-damping wall to the gusset plate disposed on a bracket and by connecting the housing to the upper-floor girder by means of a pair of temporary suspending pieces; appropriately connecting opposing ones of the high-strength bolt hole portions and opposing ones of the gusset plates of the viscous vibration-damping wall and the lower-floor girder; and removing the temporary suspending pieces. Accordingly, advantages are offered in that installation work at the site and handling are made simple, shear deformation of the viscous material is prevented, and the movability of the vibration-damping wall is prevented.

Hereafter, a description will be given of the embodiments of the present invention with reference to the drawings.

EMBODIMENTS

Figure 1:
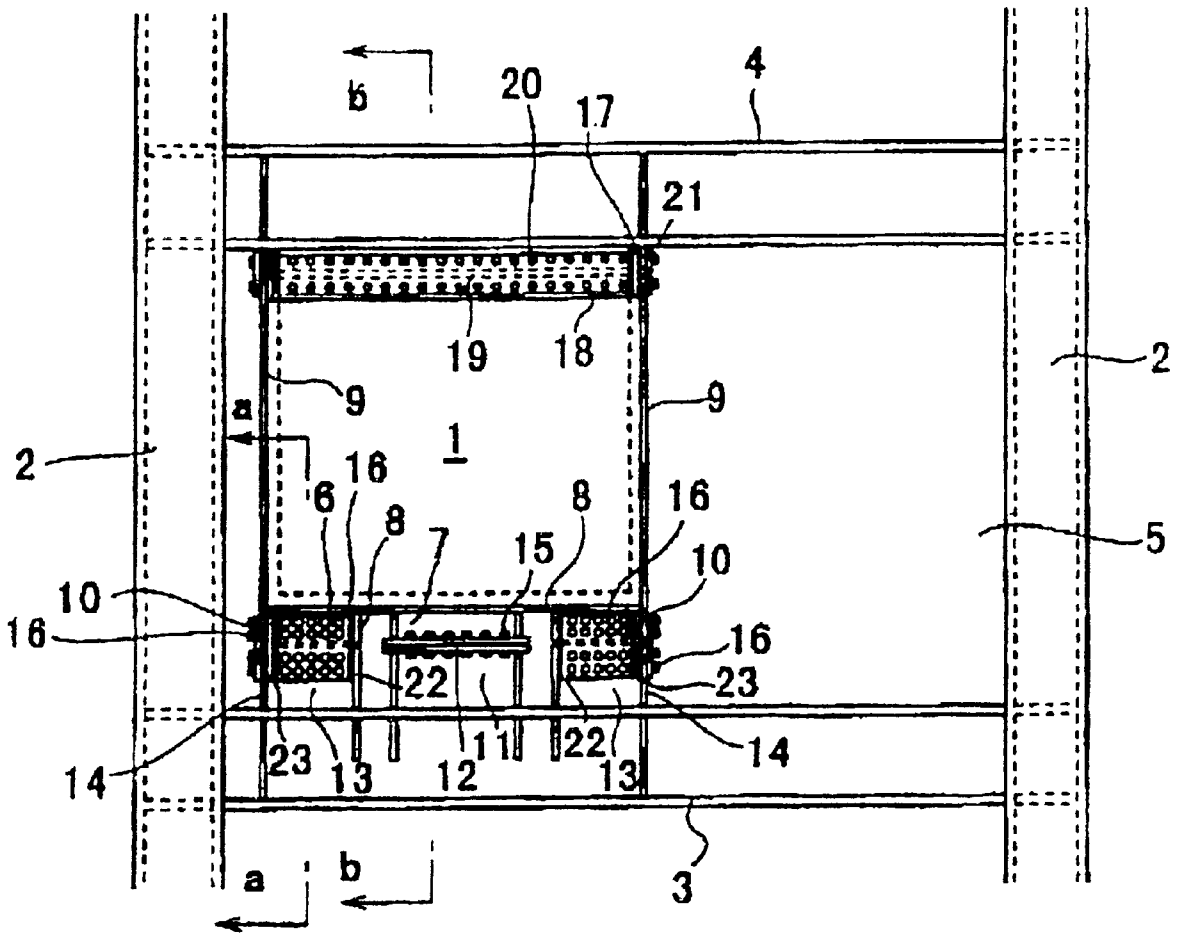
FIG. 1 is a diagram of a state in which a viscous vibration-damping wall in accordance with the invention is installed on a main frame structure.

FIG. 1 is an elevational view of a state in which a viscous vibration-damping wall in accordance with the invention is installed on a main frame structure.

A viscous vibration-damping wall 1 is disposed in a plane of structure 5 which is formed by a pair of pillars 2, a lower-floor girder 3, and an upper-floor girder 4, and is joined to the lower-floor girder 3 and the upper-floor girder 4, respectively.

At a lower end of the viscous vibration-damping wall 1, a joining member 7 is attached to a central portion of a base plate 6 and is provided with high-strength bolt hole portions, and a pair of gusset plates 8 are suspended in the same direction as that of an intermediate plate from the base plate 6 at positions close to side end portions of the viscous vibration-damping wall 1 on both sides of the joining member 7. The length of the gusset plates 8 is set to be a dimension shorter than that of the joining member 7, and the arrangement provided is such that the self-weight of the viscous vibration-damping wall is received by the joining member 7 formed integrally with the base plate.

In addition, a pair of gusset plates 10 having the same length as the gusset plates 8 are also suspended orthogonally from a pair of flange plates 9, respectively.

Although the viscous vibration-damping wall 1 may be directly mounted on the lower-floor girder 3 provided with base-plate connecting hole portions and embedded gusset plates, in this embodiment a description will be given of the viscous vibration-damping wall which is provided with a rising metal plate for the reason which will be described later.

A flat plate 12 corresponding to the joining member 7 of the viscous vibration-damping wall 1 is welded to a rising metal plate 11 welded to a flange surface of the lower-floor girder 3, and is provided with high-strength bolt hole portions for connection to the joining member.

A pair of gusset plates 13 opposing the gusset plates 8 suspended from the base plate 6 as well as a pair of gusset plates 14 opposing the gusset plates 10 suspended from the flange plates 9 are embedded on both sides of the rising metal plate 11.

The rising metal plate 11 is adopted to set the working plane for the friction-type high-strength bolted connection of the viscous vibration-damping wall 1 on a floor slab without damaging the base material of the lower-floor girder 3 by bolt holes and the like. The adoption of the rising metal plate 11 has an advantage in that when the need has arisen to replace the viscous vibration-damping wall 1, the replacement work is facilitated.

The viscous vibration-damping wall 1 is mounted on the rising metal plate 11, and the joining member 7 of the viscous vibration-damping wall and the rising metal plate 11 are frictionally connected at 15 in one plane by high-strength bolted connection. Similarly, the gusset plates 8 provided on the base plate 6 on both sides of the joining member 7 as well as the gusset plates 10 provided on the flange plates 9 are respectively connected to the opposing gusset plates 13 and 14 provided on the lower-floor girder by two-plane friction-type high-strength bolted connection 16 using pairs of splicing plates, thereby integrally joining the viscous vibration-damping wall 1 and the lower-floor girder 3.

The aforementioned direct connection between the gusset plates does not necessarily require the splicing plates.

In the case of the connection between the gusset plate 8 and the gusset plate 13, if welding positions of the two gusset plates are offset in advance from the center of the viscous vibration-damping wall and the center of the web of the lower-floor girder such that the center of the web of the lower-floor girder and the center of the viscous vibration-damping wall are aligned with each other, the gusset plate 8 and the gusset plate 13 can be directly connected by one-plane friction-type high-strength bolted connection.

Similarly, in the case of the connection between the gusset plate 10 and the gusset plate 14, if the gusset plate 14 is embedded in the lower-floor girder 3 so that the surface of the gusset plate 14 is located at such a position that it can be brought into surface contact with either surface of the gusset plate 10, the gusset plate 10 and the gusset plate 14 can be directly connected by one-plane friction-type high-strength bolted connection.

The adoption of this one-plane friction-type connection contributes to the reduction of the cost since the splicing plates are disused.

The gusset plates provided in various portions process as the shearing force of the high-strength bolts the bending moment occurring due to the shearing force which is borne by the viscous vibration-damping wall 1 during an earthquake, by making use of the fact that the bending moment is converted to vertical force at the portions on both sides of the viscous vibration-damping wall, thereby suppressing and damping the lifting force of the base plate and the vertical force occurring substantially in edge portions of the viscous vibration-damping wall.

Accordingly, the connection between the joining member 7 of the viscous vibration-damping wall 1 and the rising metal plate 11 is of the base plate type in the same way as the conventional art. However, since the joining member 7 and the rising metal plate 11 are located at a central portion of the viscous vibration-damping wall 1, tension members concerning the bending moment becomes small, and the tensile force does not occur in the connection bolts unlike the conventional viscous vibration-damping wall, so that there is no need for the reinforcing rib plates and a simple state of connection with a small thickness is sufficient.

In addition, since the connection of the gusset plates for joining both end portions of the viscous vibration-damping wall is also direct connection based on two-plane friction-type high-strength bolted connection using the splicing plates, the vertical force based on the bending moment is rationally processed without causing the tensile force to occur in the high-strength bolts for connection, and it is possible to cope with the vertical force with a simple connecting structure for which the reinforcing rib plates and the like are not required.

A gusset plate 17 is attached by welding to a lower flange surface of the upper-floor girder 4 in alignment with the web of the girder.

In order to be directly connected to the aforementioned gusset plate 17, an intermediate plate 18 of the viscous vibration-damping wall 1 is clamped together with the gusset plate 17 by two splicing plates 19, and is thereby subjected to two-plane friction-type high-strength bolted connection 20. Further, at both end portions of the gusset plate 17 and the intermediate plate 18, each of a pair of flange plates 21 of the gusset plate 17 and each of a pair of flange plates provided on the intermediate plate 18 are clamped by two splicing plates, and are firmly connected to each other by being frictionally connected in two planes by the high-strength bolts. The viscous vibration-damping wall 1 and the upper-floor girder 4 are thus integrally joined.

In the direct connection between the gusset plate 17 and the intermediate plate 18, since a top plate provided on a conventional intermediate plate and brackets suspended from the upper-floor girder are eliminated, the height of the viscous vibration-damping wall can be made large, and the shear area of the viscous vibration-damping material is increased, thereby making it possible to improve the damping performance.

It should be noted that the pair of flange plates provided at both ends of the intermediate plate 18 in a direction perpendicular to the girder web of the upper-floor girder are provided with bolt hole portions for attaching temporary suspending pieces which will be described later.

Figure 2A:
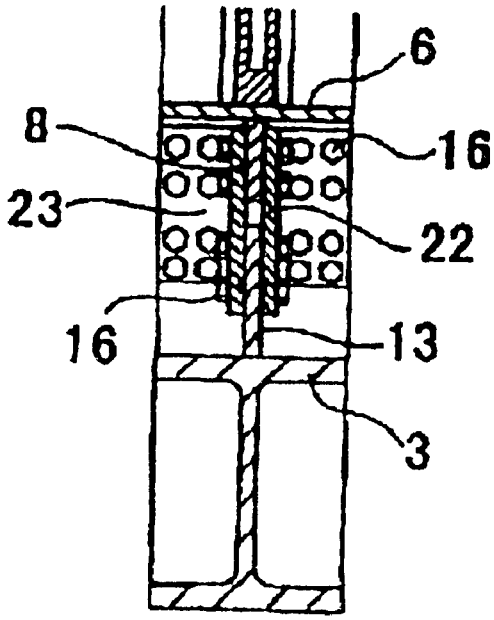
FIG. 2*a* is an enlarged cross-sectional view of a portions of the viscous vibration-damping wall according to the present invention and as illustrated in part in FIG. 2*b*.
Figure 2B:
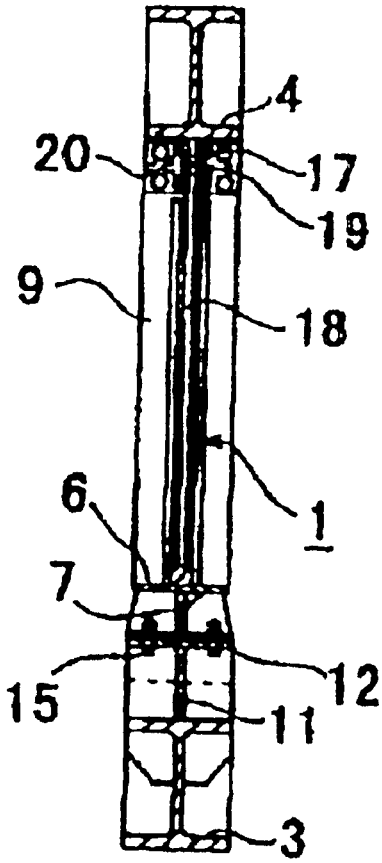
FIG. 2*b* is an enlarged cross-sectional view illustrating further portions viscous vibration-damping wall including the portions illustrated in FIG. 2*a*.

FIG. 2 is a cross-sectional view of various portions in a state in which the viscous vibration-damping wall is installed on the main frame structure.

FIG. 2(*a*) is a partial cross-sectional view taken in the direction of arrows a—a in FIG. 1, and illustrates the state of connection between, on the one hand, the lower-floor girder and, on the other hand, the gusset plates disposed on both end portions of the base plate and the gusset plates suspended from the flange plates in the viscous vibration-damping wall.

The gusset plate 8 suspended from the base plate and the gusset plate 13 embedded in the lower-floor girder are directly connected by the two-plane friction-type high-strength bolted connection 16 using splicing plates 22, as shown in the drawing.

Similarly, each splicing plate 23 shown in elevation is used for the two-plane friction-type high-strength bolted connection 16 adopted for the direct connection between the gusset plate 10 suspended from the flange plate 9 arranged on each side of the viscous vibration-damping wall 1 and the gusset plate 14 embedded in face-to-face relation thereto.

In this embodiment, as is apparent from the cross-sectional view of FIG. 2(*a*), when a horizontal force with respect to a building due to an earthquake or the like is applied to the viscous vibration-damping wall 1, all the vertical tensile force caused by the bending moment due to the shearing force of the viscous vibration-damping wall 1 is processed as the shear stress of the high-strength bolts in the direct connection of the gusset plates. Hence, the transmission of the stress is made reasonable and rational.

FIG. 2(*b*) is a cross-sectional view of a central portion in the method of installation of the viscous vibration-damping wall.

The viscous vibration-damping wall 1 is mounted on the rising metal plate 11, and the high-strength bolt hole portions of the joining member 7 provided in the central portion of the viscous vibration-damping wall and the high-strength bolt hole portions of the rising metal plate 11 are subjected to one-plane friction-type high-strength bolted connection 15. In addition, the intermediate plate 18 of the viscous vibration-damping wall 1 and the gusset plate 17 provided on the upper-floor girder 4 are clamped at their central portions by the pair of splicing plates 19 and are subjected to two-plane friction-type high-strength bolted connection 20. At the end portions on both sides of the intermediate plate 18 and the gusset plate 17, each flange plate 21 of the gusset plate 17 and each flange plate provided on the intermediate plate 18 are clamped by the pair of splicing plates and are firmly connected by two-plane friction-type high-strength bolted connection.

As shown in the drawing, although the joining member 7 is frictionally connected in one plane on both sides of the cross-sectional center of the viscous vibration-damping wall, since the aforementioned bending moment does not occur in the central portion of the viscous vibration-damping wall, the lifting force does not occur in the flanges on both sides of the joining member 7. Hence, the tensile stress does not occur in the high-strength bolts in the one-plane friction-type high-strength bolted connection 15.

Therefore, as for the base plate, the joining member, the rising metal plate, and the like, it becomes possible to provide measures by using structural members which are substantially reduced as compared with the conventional structure, and it becomes possible to adopt a structure which utterly does not require the reinforcing ribs and the like.

Figure 3:
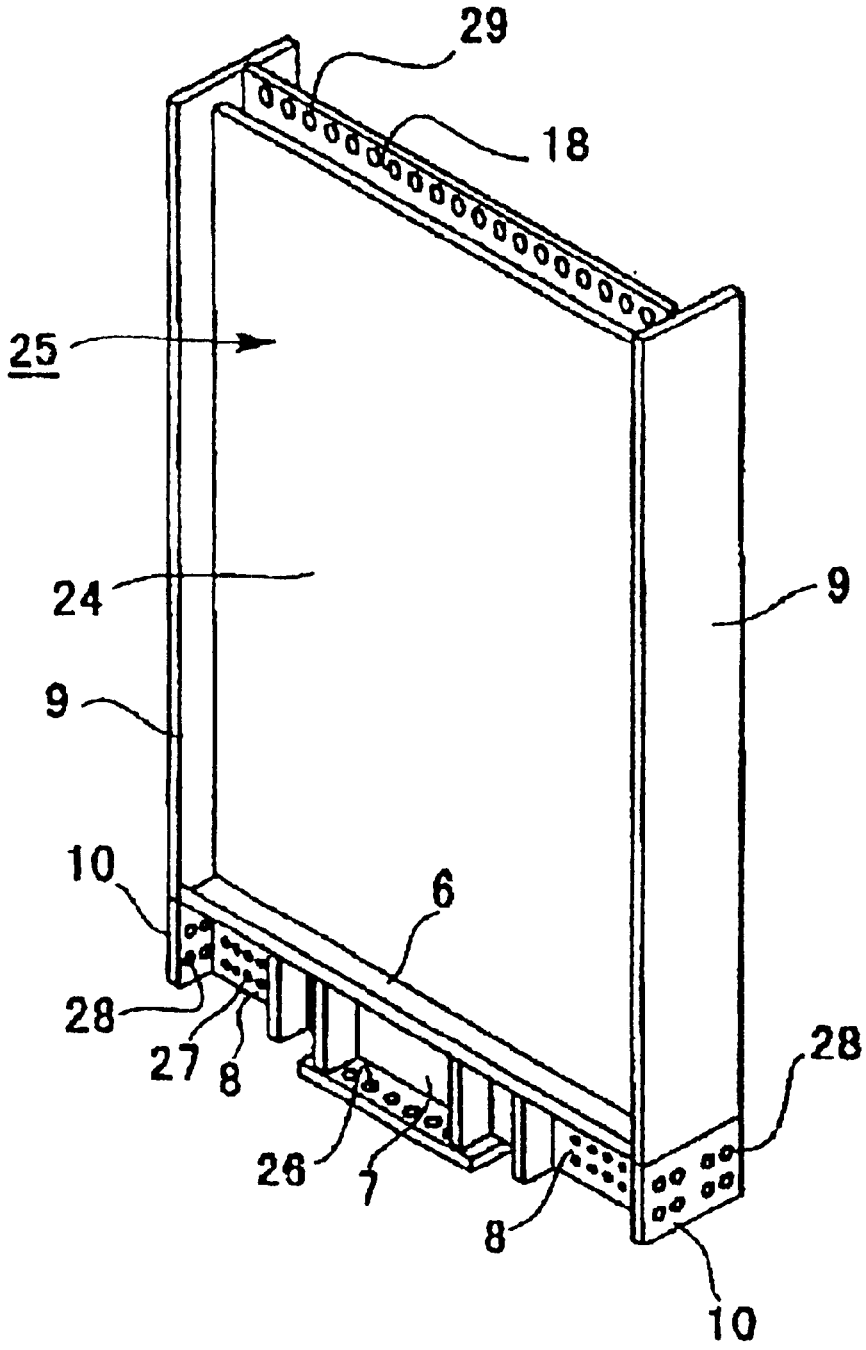
FIG. 3 is a perspective view of the viscous vibration-damping wall in accordance with the invention.

FIG. 3 is a perspective view of the viscous vibration-damping wall.

In the viscous vibration-damping wall 1, as shown in the drawing, a housing 25 with its upper end open is formed by uprightly setting a pair of steel-made side plates 24 on the base plate 6 and by disposing the pair of flange plates 9 on both sides of the pair of side plates 24, and the intermediate plate 18 is inserted in the housing 25. A viscous material or a viscoelastic material is placed in the gap between the housing 25 and each side of the intermediate plate 18, and the arrangement provided is such that a horizontal force applied from the outside is dampened between the base plate 6 and the intermediate plate 18.

It should be noted that although, in this embodiment, a description is given of the intermediate plate 18 as being a single plate, since, as is known, it is the means of the conventional practice to attempt the reinforcement of the seismic control force by arranging a plurality of intermediate plates in parallel in the viscous vibration-damping wall, it is naturally possible to adopt a plurality of intermediate plates in the method of installing the viscous vibration-damping wall in accordance with the invention.

The joining member 7 is attached to the central portion of the base plate 6 at the lower end of the viscous vibration-damping wall 1 as shown in the drawings, and the pair of gusset plates 8 are suspended in the same direction as that of the intermediate plate from the base plate 6 at positions close to side end portions of the viscous vibration-damping wall 1 on both sides of the joining member 7. The length of the gusset plates 8 is set to be a dimension shorter than that of the joining member 7 for the aforementioned reason. Also, the pair of gusset plates 10 having the same length as the gusset plates 8 are orthogonally suspended from the pair of flange plates 9.

The above-described base plate method enhances the safety of construction work and facilitates site work since the viscous vibration-damping walls can be self-supported stably during their transportation, storage, and on-site setting.

Although the base plate 6 in its outward appearance appears to be the same as the conventional viscous vibration-damping wall, since it is unnecessary to withstand the vertical force, there is no need to provide the reinforcing rib plates, and the base plate 6 can be provided with small thickness and simple shape, as described above.

As shown in the drawings, the joining member 7 and the gusset plates 8 and 10 are provided with high-strength bolt hole portions 26, 27, and 28 for being connected to the high-strength bolt hole portions provided in the flat plate 12 of the rising metal plate and the respectively opposing gusset plates embedded in the lower-floor girder. High-strength bolt hole portions 29 for being directly connected to the aforementioned gusset plate 17 are provided at a tip portion of the intermediate plate 18.

Figure 4:
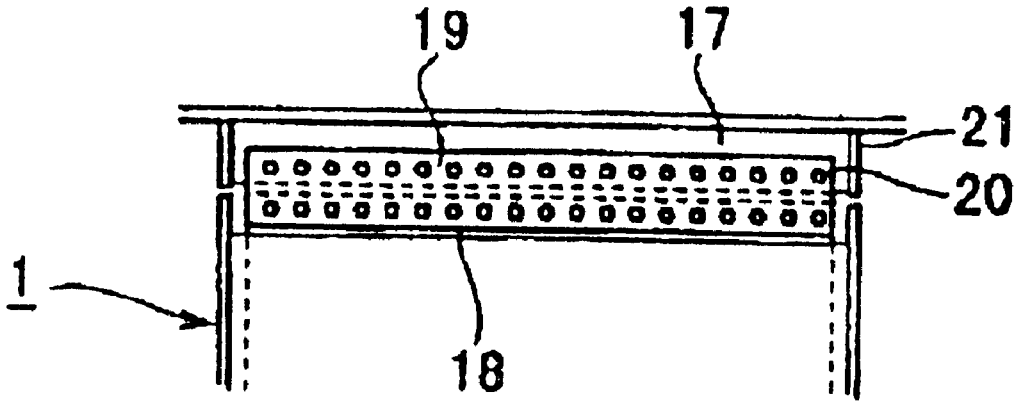
FIG. 4 is a diagram of a state in which the viscous vibration-damping wall is fixed to an upper-floor girder.

FIG. 4 shows an embodiment of connecting the intermediate plate and the gusset plate.

In this embodiment, the gusset plate 17 and the intermediate plate 18 are directly connected.

Namely, the gusset plate 17 and the intermediate plate 18 are clamped by the two splicing plates 19, and are connected by being subjected to the two-plane friction-type high-strength bolted connection 20. At the end portions on both sides of the gusset plate 17 and the intermediate plate 18, since each of the flange plates 21 of the gusset plate 17 and each of the flange plates provided on the intermediate plate 18 are clamped by the splicing plates and are firmly connected by the two-plane friction-type high-strength bolted connection, the viscous vibration-damping wall 1 and the upper-floor girder 4 are thereby integrally connected.

In the direct connection of the gusset plate 17 and the intermediate plate 18, the splicing plates are not necessarily required, and if the welding position of the gusset plate is offset in advance from the center of the web of the upper-floor girder such that the center of the web of the upper-floor girder and the center of the intermediate plate are aligned with each other, the direct connection of the gusset plate 17 and the intermediate plate 18 can be also effected by directly connecting them by one-plane friction-type connection using the high-strength bolts.

The adoption of this one-plane friction-type connection contributes to the reduction of the cost since the splicing plates are disused.

Figure 5:
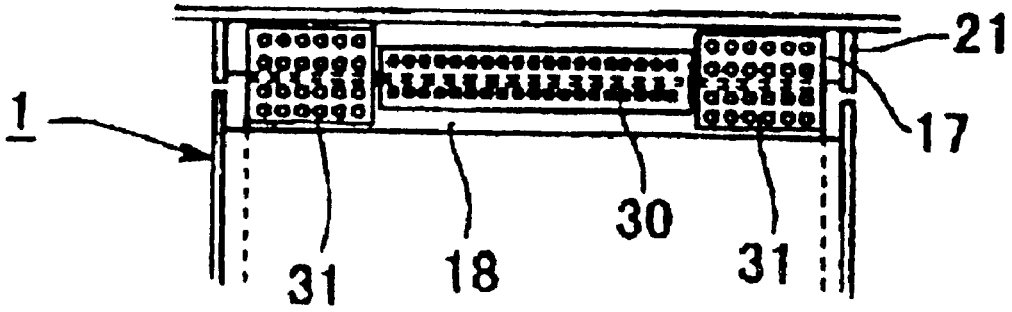
FIG. 5 is a diagram of another state in which the viscous vibration-damping wall is fixed to the upper-floor girder.

FIG. 5 shows another embodiment of connecting the intermediate plate and the gusset plate.

In this embodiment, although there is no specific change in the intermediate plate, a difference lies in that each splicing plate is divided into a central portion 30 and a pair of side portions 31. The bolt hole portions are arranged in a single row on each of upper and lower sides of the central portion 30 of the splicing plate, while two rows of bolt hole portions each on upper and lower sides are arranged on the side splicing plates 31 so as to cope with the allotted shear stresses.

The division of the splicing plate is not only rational in the allotment of the stress, but has an advantage of being able to flexibly cope with the unevenness between the gusset plate and the intermediate plate caused by the erection accuracy at the site. Further, since the weight per location can be reduced, this arrangement exhibits the advantage of allowing the operation to be performed sufficiently by the human strength of operators without using special heavy machinery or equipment.

Figure 6:
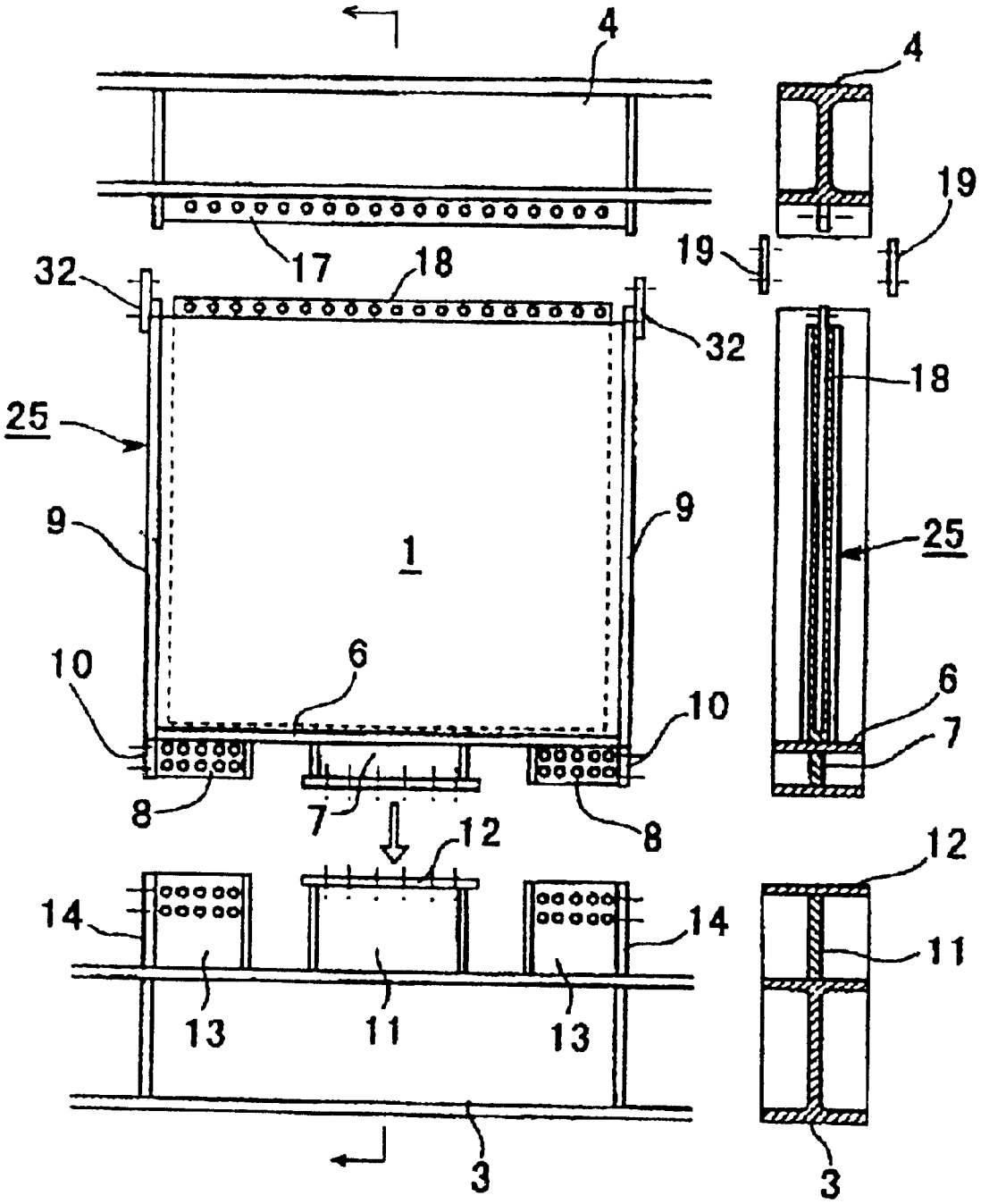
FIG. 6 is an exploded view of installation of the viscous vibration-damping wall in accordance with the invention.

FIG. 6 is an exploded view for explaining a method of installing a viscous vibration-damping wall in accordance with the invention.

The installing operation begins with the fixation to unillustrated pillars of the lower-floor girder 3 with the rising metal plate 11 and the gusset plates 13 and 14 integrated thereto by welding.

Meanwhile, the intermediate plate 18 and the housing 25 of the viscous vibration-damping wall 1 are attached to the upper-floor girder 4 by being integrally fixed by means of a pair of temporary suspending pieces 32. At the same time, the gusset plate 17 and the intermediate plate 18 are subjected to two-plane friction-type high-strength bolted connection 20 using the pair of splicing plates 19 so as to be directly connected to each other. At the end portions on both sides of the gusset plate 17 and the intermediate plate 18, each of the pair of flange plates 21 of the gusset plate 17 and each of the flange plates provided on the intermediate plate 18 are clamped by the splicing plates, and are firmly connected by the two-plane friction-type high-strength bolted connection.

In a case where there is spacewise leeway in the vicinities of the flange plates at the end portions of the gusset plate 17, instead of merely fixing the intermediate plate 18 and the housing 25 of the viscous vibration-damping wall 1 integrally, the temporary suspending pieces 32 may also directly connect the housing 25 and the flange plates to ensure that a force other than the self-weight will not be applied to the intermediate plate 18 of the viscous vibration-damping wall 1.

It should be noted that the direct connection based on the one-plane friction-type high-strength connection without using the splicing plates is the same as described before.

The upper-floor girder 4 integrated with the viscous vibration-damping wall 1 is suspended and set at a predetermined position, and even if the temporary suspending pieces 32 are used by whichever method, it is possible to prevent the viscous material from undergoing shear deformation by the self-weight of the viscous vibration-damping wall and fix the viscous vibration-damping wall immovably so as to suppress its rotation about the axis of the girder during hanging.

Upon completion of positioning, one-plane friction-type high-strength bolted connection 15 is effected between the bolt hole portions 26 of the joining member 7 and the high-strength bolt hole portions of the rising metal plate 11, thereby completing the installation of the viscous vibration-damping wall 1 on the main frame structure.

At this stage, if the aforementioned temporary suspending pieces 32 are removed, the housing 25 of the viscous vibration-damping wall 1 is connected to the lower-floor girder 3, and the intermediate plate 18 of the viscous vibration-damping wall 1 is connected to the upper-floor girder 4, which makes it possible for the viscous vibration-damping wall 1 to assume a movable state whereby it is capable of demonstrating its intrinsic vibration-damping function, and the installation work is thereby completed.

Figure 7:
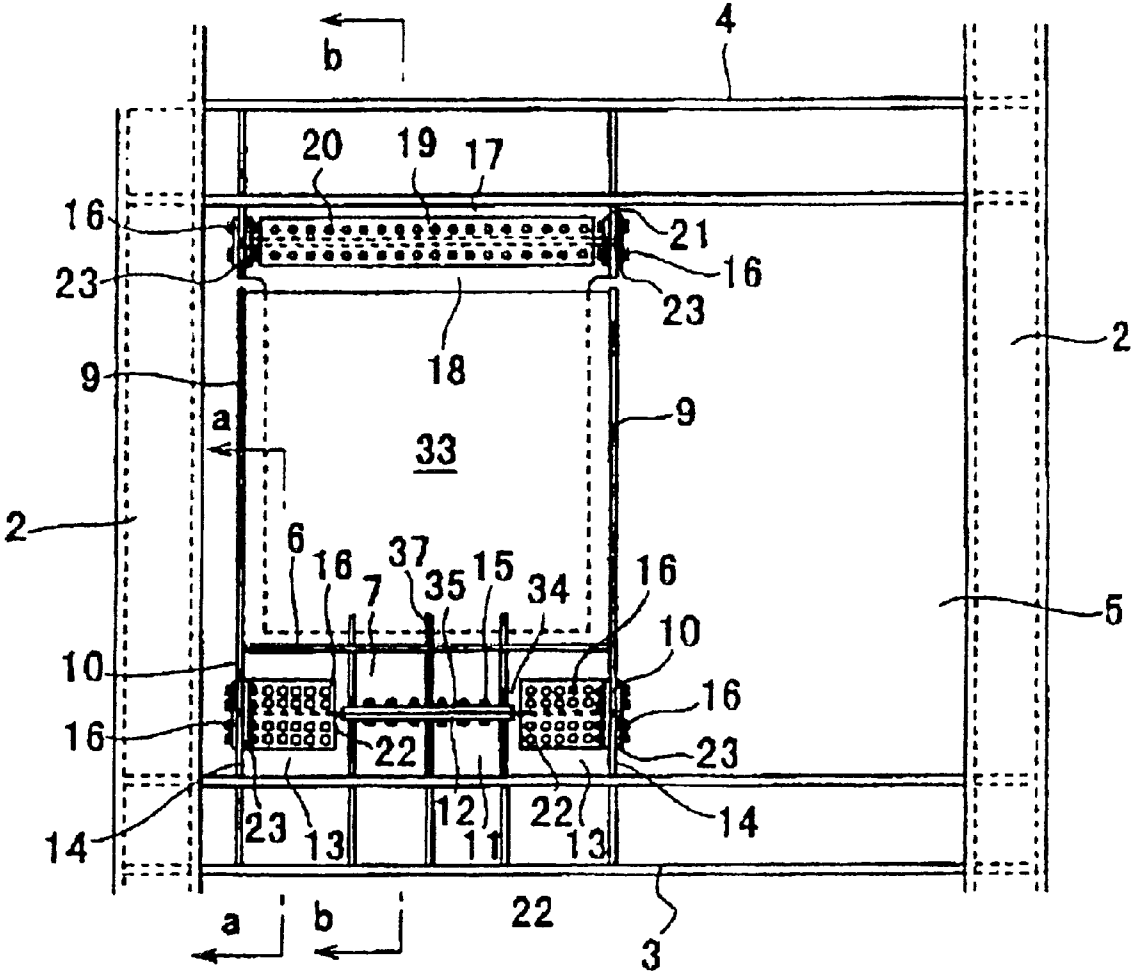
FIG. 7 is a diagram of a state in which another viscous vibration-damping wall in accordance with the invention is installed on the main frame structure.

FIG. 7 is a perspective view of another embodiment of the viscous vibration-damping wall.

In a viscous vibration-damping wall 33, although its basic structure is similar to that of the above-described viscous vibration-damping wall 1, improvements are made on the structure for connection to the lower-floor girder.

Namely, the joining member 7, which is disposed at the central portion of the lower end of the base plate 6, and the pair of gusset plates 8, which are spaced apart from each other and separately disposed at positions close to the side end portions of the viscous vibration-damping wall 1 on both sides of the joining member 7, are formed integrally as a single steel plate 34 in the viscous vibration-damping wall 1. The steel plate 34 is provided with a function similar to that of the joining member 7 of the viscous vibration-damping wall 1 as a joining/receiving plate 35 is attached horizontally to its central portion by welding, and the joining/receiving plate 35 is provided with the high-strength bolt hole portions 26. Both sides of the central portion of the steel plate 34 correspond to the gusset plates 8 suspended from the base plate of the viscous vibration-damping wall 1, and are provided with the high-strength bolt hole portions 27 for connection to the gusset plates embedded in the lower-floor girder.

Accordingly, since the joining/receiving plate 35 is positioned lower than the other portions of the steel plate 34, the stability at the time of handling the viscous vibration-damping wall 33 is ensured.

It should be noted that, as shown in the drawing, the steel plate 34 and the joining/receiving plate 35 are supported by reinforcing ribs to ensure the strength, and the other arrangements including the gusset plates 10 suspended from the flange plates 9 and joined integrally to the steel plate 34 by welding are similar to those of the above-described embodiment.

In this embodiment, the joining/receiving plate 35 is welded to the steel plate 34, and is subjected to one-plane friction type connection on both sides of the cross-sectional center of the viscous vibration-damping wall. However, since the lifting force does not occur in the joining/receiving plate 35, the tensile stress does not occur at the weld surfaces and the high-strength bolts at the one-plane friction-type high-strength bolted connection 15, so that it is possible to adopt a structure having leeway strengthwise.

Accordingly, as for the base plate, the steel plate, the joining/receiving plate, the rising metal plate, and the like, it becomes possible to provide measures by using structural members which are substantially reduced as compared with the conventional structure, and the lower structure for connecting to the lower-floor girder is substantially simplified. Therefore, structural processing and the number of steps of assembly are reduced, so that a large contribution can be made in terms of the reduction of the cost.

Figure 8A:
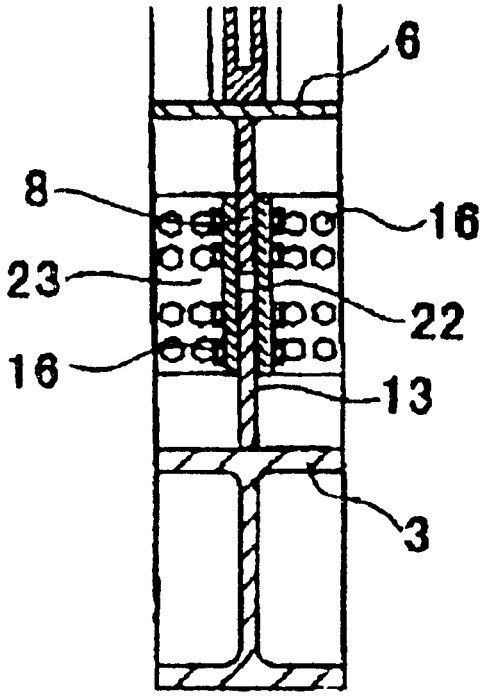
FIG. 8*a* is a cross-sectional view of a portion of another viscous vibration-damping wall in accordance with the invention.
Figure 8B:
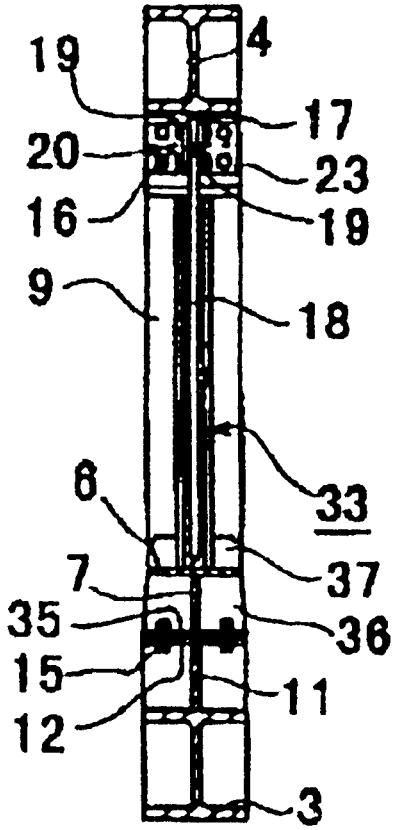
FIG. 8*b* is a reduced cross-sectional view of the viscous vibration-damping wall portion illustrated in FIG. 8*a*.

FIG. 8 is a cross-sectional view of various parts in the state in which the other viscous vibration-damping wall is installed on the main frame structure.

FIG. 8(*a*) is a partial cross-sectional view taken in the direction of arrows a—a in FIG. 7, and illustrates a state of connection between, on the one hand, the high-strength bolt hole portions 27 disposed at both end portions of the steel plate 33 suspended from the base plate 6 of the viscous vibration-damping wall 33 and the gusset plates suspended from the flange plates and, on the other hand, the lower-floor girder.

The high-strength bolt hole portions 27 of the steel plate 34 suspended from the base plate and the gusset plates 13 embedded in the lower-floor girder are directly connected by the two-plane friction-type high-strength bolted connection 16 using the splicing plates 22, as shown in the drawings.

Similarly, each splicing plate 23 shown in elevation is used for the two-plane friction-type high-strength bolted connection 16 adopted for the direct connection between the gusset plate 10 suspended from the flange plate 9 arranged on each side of the viscous vibration-damping wall 33 and the gusset plate 14 embedded in face-to-face relation thereto.

FIG. 8(*b*) is a cross-sectional view of the central portion in the method of installing the viscous vibration-damping wall. The viscous vibration-damping wall 33 is mounted on the rising metal plate 11, and the high-strength bolt hole portions 26 of the joining/receiving plate 35 provided in the central portion of the steel plate 34 and the high-strength bolt hole portions of the rising metal plate 11 are subjected to the one-plane friction-type high-strength bolted connection 15. In addition, the intermediate plate 18 of the viscous vibration-damping wall 33 and the gusset plate 17 provided on the upper-floor girder 4 are clamped at their central portions by the pair of splicing plates 19 and are subjected to the two-plane friction-type high-strength bolted connection 20. At the end portions on both sides of the intermediate plate 18 and the gusset plate 17, each flange plate 21 of the gusset plate 17 and each flange plate provided on the intermediate plate 18 are clamped by the pair of splicing plates 23 and are firmly connected by the two-plane friction-type high-strength bolted connection 16.

Figure 9:
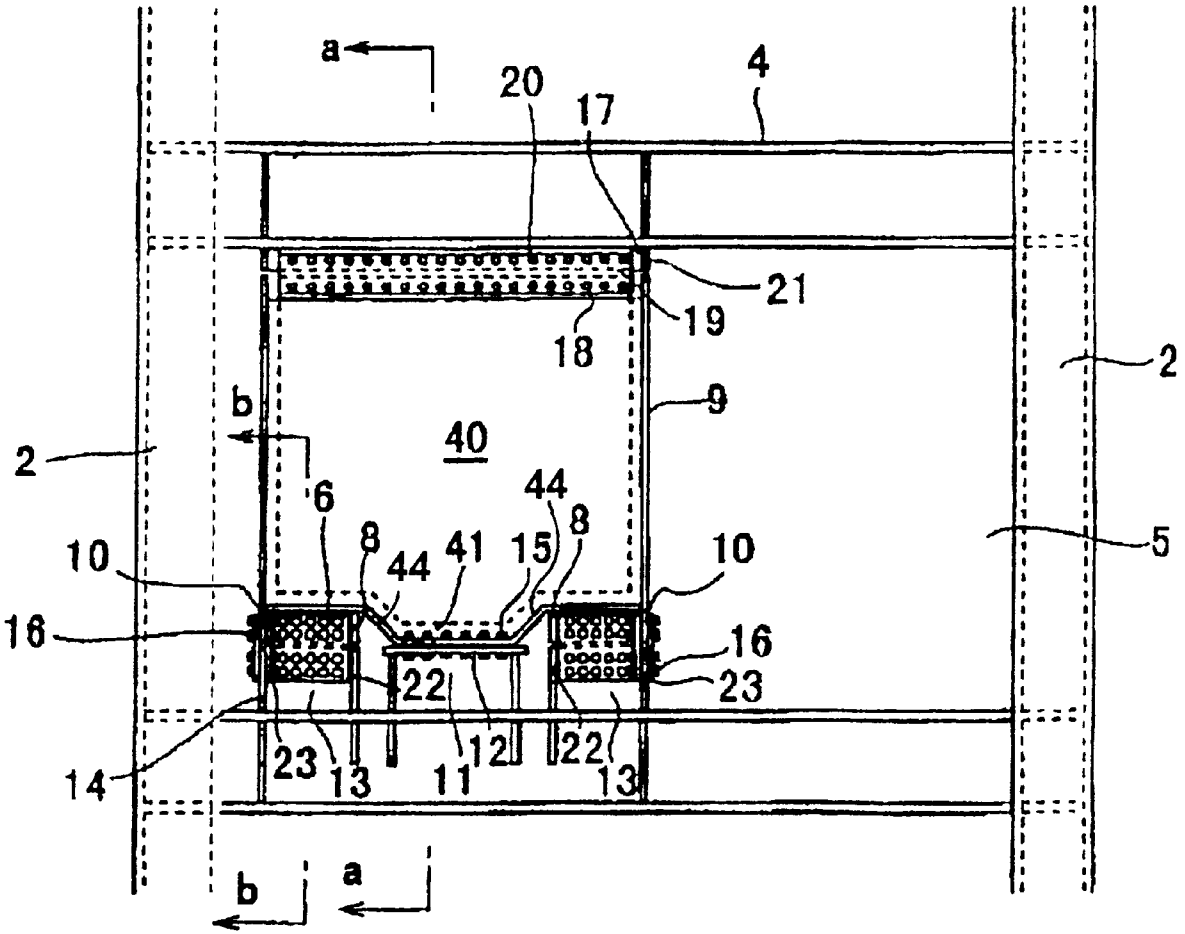
FIG. 9 is a diagram of a state in which still another viscous vibration-damping wall in accordance with the invention is installed on the main frame structure.

FIG. 9 is an elevational view illustrating another embodiment of the structure for installing a viscous vibration-damping wall in accordance with the invention.

A viscous vibration-damping wall 40 in this embodiment is similar to the structure for installing a viscous vibration-damping wall described with reference to FIG. 1 in that this viscous vibration-damping wall 40 is also disposed in the plane of structure 5 formed by the pair of pillars 2, the lower-floor girder 3, and the upper-floor girder 4, and is joined to the lower-floor girder 3 and the upper-floor girder 4, respectively. However, a difference lies in the structure for installing the viscous vibration-damping wall 40 on the lower-floor girder 3.

At a lower end of the viscous vibration-damping wall 40, high-strength bolt hole portions for connection to the rising metal plate 11 are provided in a central portion 41 of the base plate 6 instead of providing the joining member 7. On both sides of the central portion 41, the base plate 6 is bent toward the upper-floor girder side in the illustration, i.e., in the upper direction of the viscous vibration-damping wall, so that the base plate 6 is provided with step portions 44 and is hence formed in the shape of a tray.

The pair of gusset plates 8 are suspended in the same direction as that of the intermediate plate from portions close to the respective ends of the tray shape in a manner similar to the example shown in FIG. 1, but their length is set to be a dimension not longer than that of the central portion 41, and the arrangement provided is such that the self-weight of the viscous vibration-damping wall is received by the central portion 41 of the base plate 6. Further, the pair of gusset plates 10 suspended from the pair of gusset plates 9 are provided with the same length as that of the gusset plates 8 and are set orthogonally thereto in the same way as the above-described example.

In addition, the shapes of the lower-floor girder and the upper-floor girder are also similar, and measures provided to connect the viscous vibration-damping wall 40 to the lower-floor girder 3 are also similar to those of the already-described example in that the central portion 41 of the base plate 6 is placed on the flange of the lower-floor girder 3 directly or on the rising metal plate 11, and is subjected to the one-plane friction-type high-strength connection 15, and that the respective gusset plates are subjected to the two-plane friction-type high-strength connection 16.

Figure 10A:
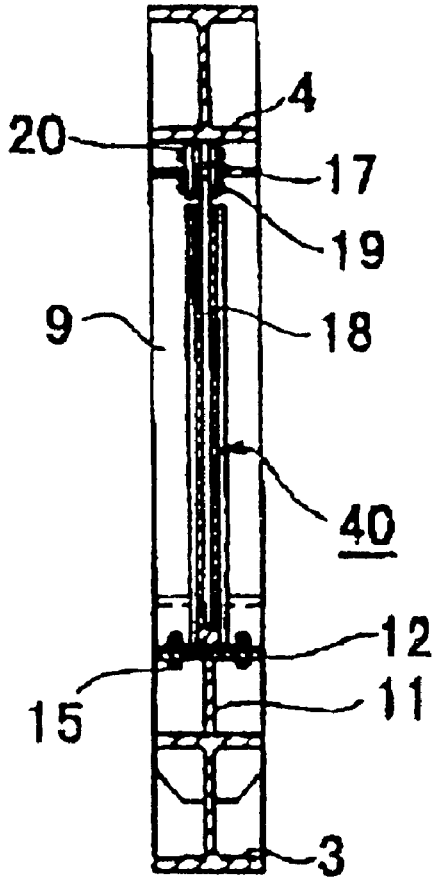
FIG. 10*a* is a cross-sectional view of various portions of the other viscous vibration-damping wall in accordance with the invention.
Figure 10B:
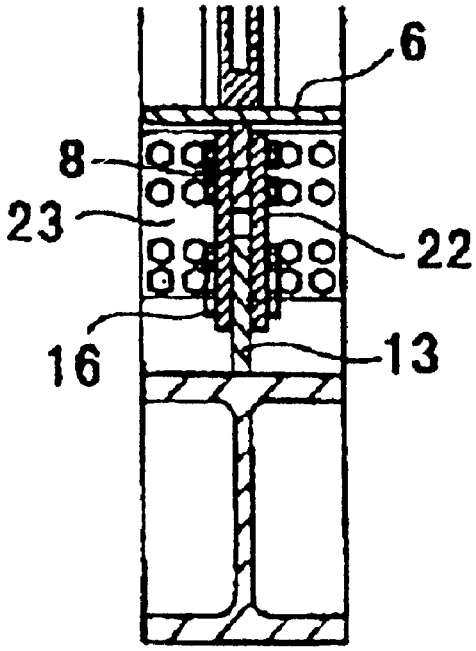
FIG. 10*b* is an enlarged fragmentary cross-sectional view of a portion of the wall of FIG. 10*a*.

FIG. 10 is a partial cross-sectional view of the structure for installing a viscous vibration-damping wall shown in FIG. 9.

FIG. 10(*a*) illustrates a state in which the central portion 41 of the base plate 6 is placed on the rising metal plate 11 provided on the lower-floor girder 3, and is connected thereto by the one-plane friction-type high-strength bolted connection 15.

As described above, since the bending moment does not occur in the central portion 41, only the shear stress is applied to the high-strength bolts for the central portion 41 and the rising metal plate 11, so that stable measures are provided.

FIG. 10(*b*) shows a state of connection of the gusset plate provided at the end portion of the viscous vibration-damping wall 40.

Since this state is similar to the one shown in FIG. 2(*b*), a description thereof will be omitted, and each connecting portion is coped with by the two-plane friction-type high-strength bolted connection. Since the vertical stress is applied to the high-strength bolts as the shear stress, so that a stable coping state is formed.

The first advantage of this embodiment lies in that, in comparison with the case where the overall base plate is merely raised, since the intermediate plate of the viscous vibration-damping wall can be enlarged by the portion in which the step is provided in the base plate, the shear area with respect to the viscous material can be increased, thereby making it possible to improve the damping performance as the damper.

The second advantage lies in that rational measures against the stress are realized since the positions and shapes for processing so as to receive all the stress by the shear stress of the high-strength bolts are clarified as the horizontal force applied to the viscous vibration-damping wall due to the horizontal force from outside the building is coped with by the central portion, while the vertical force occurring in the end portions due to the bending moment occurring in the viscous vibration-damping wall is coped with by the gusset plates.

In the foregoing embodiments, it has been described that the gusset plate suspended from the base plate and the gusset plates suspended from the flange plates, on the one hand, and the gusset plates respectively opposing thereto and embedded in the lower-floor girder, on the other hand, are all connected.

However, depending on values of the vertical force occurring in the end portions due to the bending moment occurring in the viscous vibration-damping wall, the connection of the gusset plates suspended from the flange plates may be omitted, and the vertical force may be coped with by only the gusset plate suspended from the base plate. Alternatively, on the contrary, the gusset plates may be connected after appropriately selecting them in correspondence with the assumed vibration-damping force.

Figure 11:
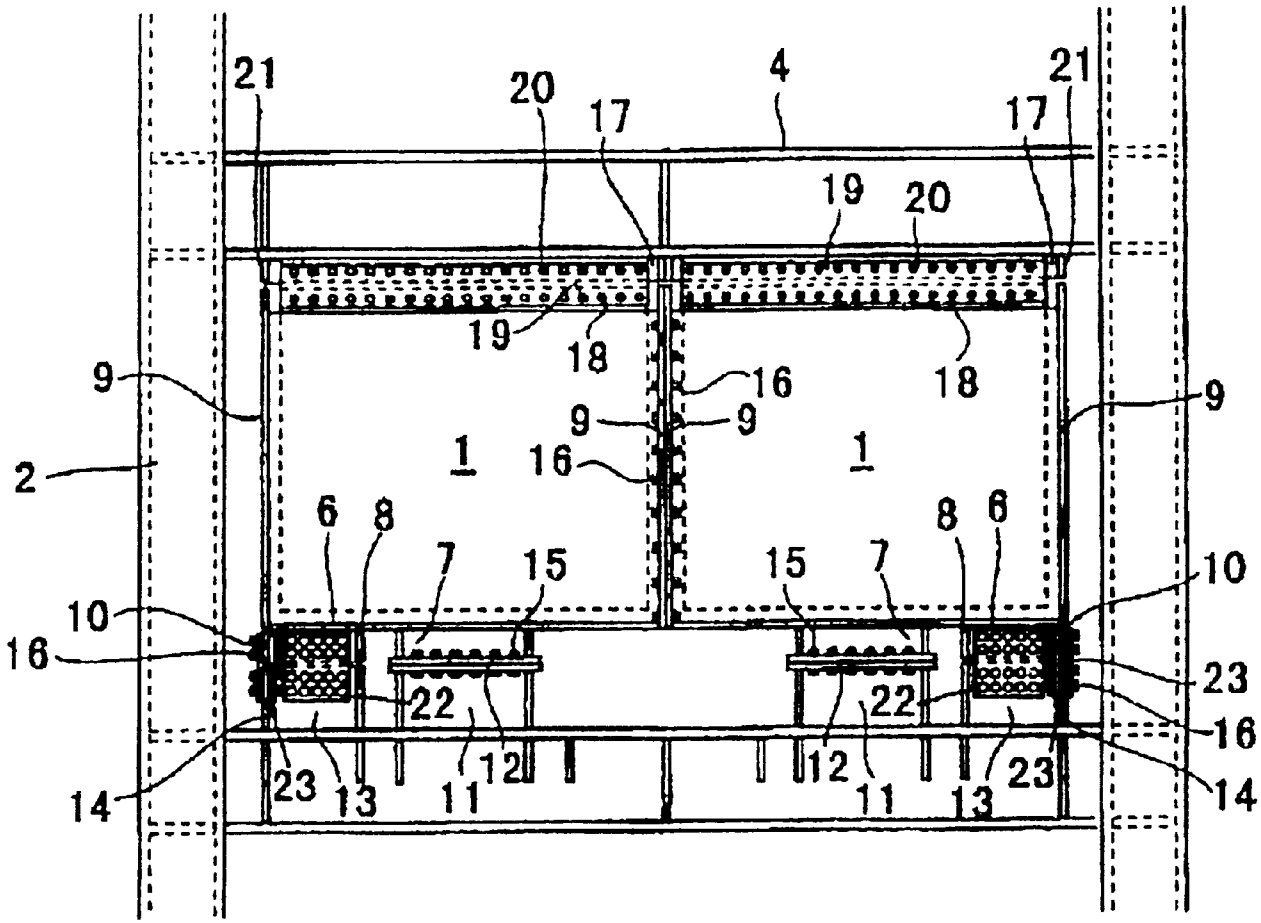
FIG. 11 is a diagram of a state of installation in which a plurality of viscous vibration-damping walls are installed in a juxtaposed manner on the main frame structure in accordance with the invention.

FIG. 11 is an elevational view of a state in which the viscous vibration-damping walls in accordance with the invention are installed in a juxtaposed manner. A pair of viscous vibration-damping walls 1 are installed in a juxtaposed manner in the plane of structure 5 which is formed by the pair of pillars 2, the lower-floor girder 3, and the upper-floor girder 4, and is joined integrally to the lower-floor girder 3 and the upper-floor girder 4.

The two viscous vibration-damping walls 1 are placed on the rising metal plate 11 welded to the flange surface of the lower-floor girder 3 and formed integrally with the lower-floor girder 3. The gusset plates 13 and 14 are embedded at positions opposing the gusset plates 8 and 10 suspended from both outer ends of the integrated assembly of the viscous vibration-damping walls 1.

The viscous vibration-damping walls 1 at their mutually opposing flange plates 9 on their one sides are subjected to the one-plane friction-type high-strength bolted connection 15, and this assembly in the integrated state is placed on the rising metal plate 11.

The viscous vibration-damping walls 1 are integrally connected to the lower-floor girder 3 as the respective joining members 7 and the rising metal plate 11 are subjected to the one-plane friction-type high-strength bolted connection 15, and the gusset plates 8 and 10 on the outer ends and the gusset plates 13 and 14 provided on the lower-floor girder 3 are subjected to the two-plane friction-type high-strength bolted connection 16.

The integrally connected viscous vibration-damping walls 1 process the lifting force of the base plates and the vertical force occurring in edge portions of the viscous vibration-damping walls as the bending moment due to the shearing force which is borne during an earthquake is received as the shearing force of the high-strength bolts by the gusset plates.

Two gusset plates 17 are attached to the lower flange surface of the upper-floor girder 4 in alignment with the web of the girder in the same way as the above-described embodiment.

The intermediate plate 18 of each viscous vibration-damping wall 1 and the gusset plate 17 are clamped by the two splicing plates 19, and are subjected to two-plane friction-type high-strength bolted connection 20, thereby allowing the viscous vibration-damping walls 1 and the upper-floor girder 4 to be integrally connected.

Figure 12:
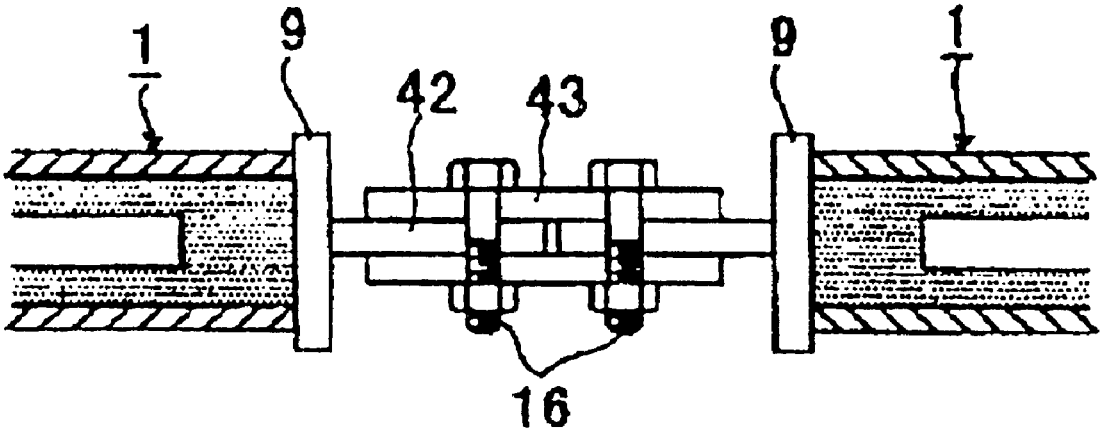
FIG. 12 is a diagram of another state of installation in which a plurality of viscous vibration-damping walls are juxtaposed.
Figure 13B:
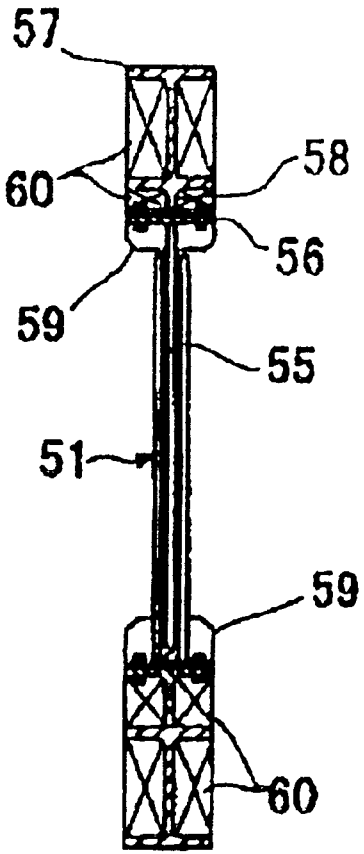
FIGS. 13*a* and 13*b* are respective fragmentary side elevational and cross-sectional views illustrating a state of the conventional installation of a viscous vibration-damping wall.
Figure 13A:
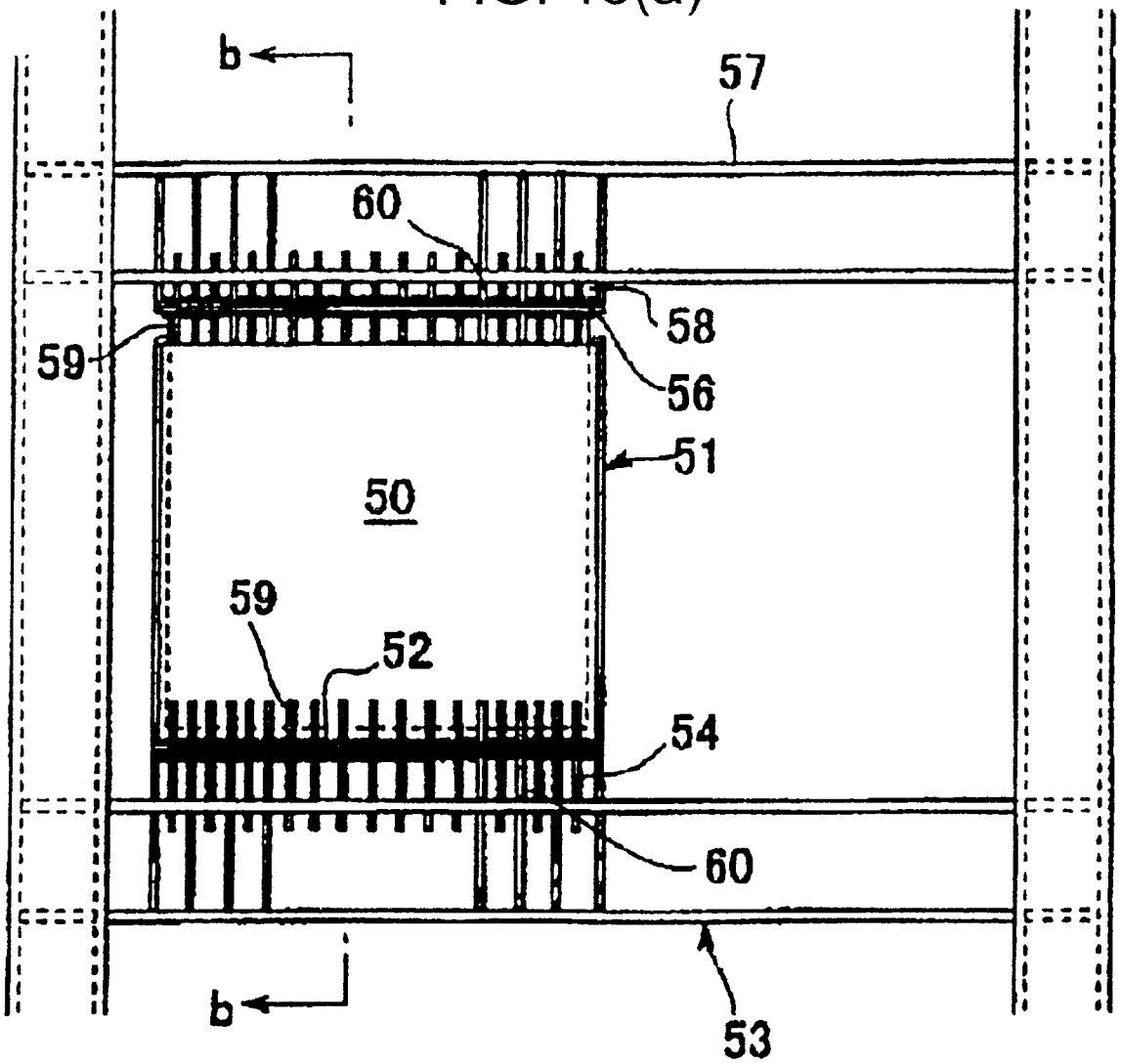
Figure 14B:
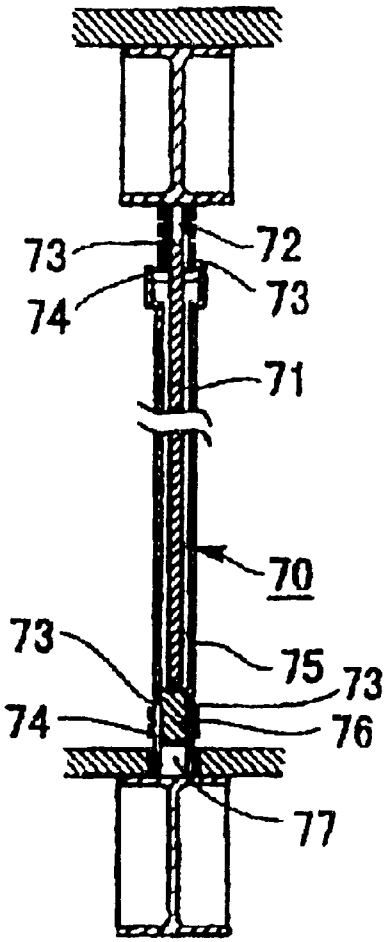
FIGS. 14*a* and 14*b* are respective elevation and cross-sectional views of another state of the conventional installation of a viscous vibration-damping wall.
Figure 14A:
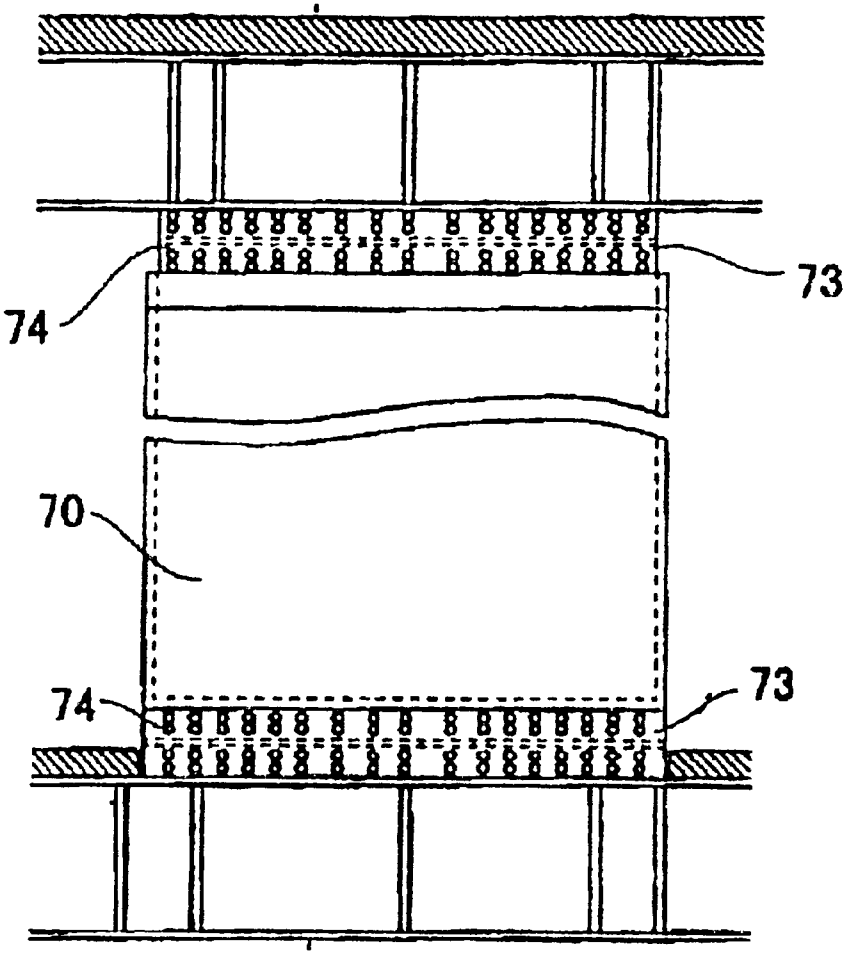

FIG. 12 shows still another embodiment in which a plurality of viscous vibration-damping walls are joined to each other. On each opposing flange plate 9 of the viscous vibration-damping wall 1, a gusset plate 42 is disposed in parallel with the upper- and lower-floor girders, and is provided with high-strength bolt hole portions.

When the two viscous vibration-damping walls 1 are integrated, as shown in the drawing, the two gusset plates 42 are brought close to each other and are clamped by two splicing plates 43, and are connected by the two-plane friction-type high-strength bolted connection 20.

In the case of this embodiment, since the operator is able to perform the connecting operation with a posture oriented perpendicular to the viscous vibration-damping wall, there is a degree of freedom in the operator's movement as compared with the case where the flange plates 9 are directly joined, so that there is an advantage in that the installation work can be performed simply with a comfortable posture.

As described above, the structure for installing a viscous vibration-damping wall in accordance with the invention is not limited to the installation of a single viscous vibration-damping wall, and is also applicable to the case where a plurality of viscous vibration-damping walls are installed in a juxtaposed manner.

Regardless of the number of the viscous vibration-damping walls to be juxtaposed, by subjecting the flange plates on their mutually opposing sides to one-plane friction-type high-strength bolted connection or two-plane friction-type high-strength bolted connection using the gusset plates disposed at the flange plates, the entire unit can be handled as one viscous vibration-damping wall. In the fixation of the viscous vibration-damping walls to the upper-floor girder, the integration with the upper-floor girder can be ensured by merely attaching the temporary suspending pieces to the outer flange plates.

What is claimed is:

1. A structure for installing a viscous vibration-damping wall between a lower girder and an upper girder, said viscous vibration-damping wall having a housing with an open upper end, an intermediate plate inserted in said housing through said open upper end and a viscous material or a viscoelastic material placed in a gap portion between said housing and said intermediate plate, said housing having a base plate, a pair of steel-made side plates uprightly set on said base plate, and a pair of flange plates disposed on both lateral ends of said pair of side plates, respectively; comprising first high-strength bolt hole portions for connecting a central portion of said base plate to a flange of said lower-floor girder, a pair of first gusset plates provided at both lateral sides of a group of said first high-strength bolt hole portions and suspended downwardly from said base plate, respectively, said first gusset plates each having a face extending in the same direction as that of said intermediate plate, a pair of second gusset plates suspended downwardly from said pair of flange plates, respectively, said second gusset plates each having a face extending orthogonally with respect to a face of said intermediate plate, second high-strength bolt hole portions for connecting said central portion of said base plate to said flange of said lower-floor girder in cooperation with said first high-strength bolt hole portions, said second high-strength bolt hole portions opposing said first high-strength bolt hole portions, a pair of third gusset plates provided on said flange of said lower-floor girder at both lateral sides of a group of said second high-strength bolt hole portions so as to oppose said first gusset plates, respectively, a pair of fourth gusset plates provided on said flange of said lower-floor girder so as to oppose said second gusset plates, respectively, and a fifth gusset plate fixed to a flange of said upper girder, said viscous vibration-damping wall being connected to said lower-floor girder by connecting opposing ones of said first and second high-strength bolt hole portions and opposing ones of said first to fourth gusset plates, and said viscous vibration-damping wall being connected to said upper-floor girder by directly connecting said intermediate plate to said fifth gusset plate.

2. The structure for installing a viscous vibration-damping wall according to claim 1, wherein said central portion of said base plate is provided with a joining member for connection to said flange of said lower-floor girder, and said joining member is provided with said first high-strength bolt hole portions.

3. The structure for installing a viscous vibration-damping wall according to claim 2, wherein said joining member and said pair of first gusset plates are formed integrally.

4. The structure for installing a viscous vibration-damping wall according to claim 1, wherein said base plate includes a pair of step portions, between which said central portion is disposed, said first high-strength bolt hole portions being provided on said central portion.

5. The structure for installing a viscous vibration-damping wall according to claim 1, further comprising a rising metal plate installed on said flange of said lower-floor girder, said rising metal plate being provided with said second high-strength bolt hole portions.

6. The structure for installing a viscous vibration-damping wall according to claim 1, wherein said first gusset plate is connected to said third gusset plate by means of one-plane friction-type high-strength bolted connection.

7. The structure for installing a viscous vibration-damping wall according to claim 1, wherein said second gusset plate is connected to said fourth gusset plate by means of one-plane friction-type high-strength bolted connection.

8. The structure for installing a viscous vibration-damping wall according to claim 1, further comprising a pair of splicing plates, said first gusset plate being connected to said third gusset plate by means of two-plane friction-type high-strength bolted connection using said pair of splicing plates.

9. The structure for installing a viscous vibration-damping wall according to claim 1, further comprising a pair of splicing plates, said second gusset plate being connected to said fourth gusset plate by means of two-plane friction-type high-strength bolted connection using said pair of splicing plates.

10. The structure for installing a viscous vibration-damping wall according to claim 1, wherein said intermediate plate is connected to said fifth gusset plate by means of one-plane friction-type high-strength bolted connection.

11. The structure for installing a viscous vibration-damping wall according to claim 1, further comprising a pair of splicing plates, said intermediate plate being connected to said fifth gusset plate by means of two-plane friction-type high-strength bolted connection using said pair of splicing plates.

12. The structure for installing a viscous vibration-damping wall according to claim 11, wherein each of said splicing plates includes a central plate portion and a pair of side plate portions separated from said central plate portion.

* * * * *